US005290024A

United States Patent [19]

Takahashi

[11] Patent Number: 5,290,024

[45] Date of Patent: Mar. 1, 1994

[54] AUTOMATIC SHEET FEEDING APPARATUS

[75] Inventor: Koji Takahashi, Yokohama, Japan

[73] Assignee: Canon Kabushiki Kaisha, Tokyo, Japan

[21] Appl. No.: 903,923

[22] Filed: Jun. 26, 1992

[30] Foreign Application Priority Data

| | | | |
|---|---|---|---|
| Jun. 28, 1991 | [JP] | Japan | 3-183451 |
| Jul. 19, 1991 | [JP] | Japan | 3-203632 |
| Sep. 26, 1991 | [JP] | Japan | 3-273579 |
| May 13, 1992 | [JP] | Japan | 4-120707 |
| May 13, 1992 | [JP] | Japan | 4-120710 |

[51] Int. Cl.[5] ..... B65H 3/52

[52] U.S. Cl. ..... 271/122; 271/116; 271/270

[58] Field of Search ..... 271/116, 122, 270, 10

[56] References Cited

U.S. PATENT DOCUMENTS

| | | | |
|---|---|---|---|
| 3,857,559 | 12/1974 | McInerny | 271/122 |
| 4,239,203 | 12/1980 | Uchida | 271/122 |
| 4,368,881 | 1/1983 | Landa . | |
| 4,627,607 | 12/1986 | Ishii | 271/122 |
| 4,674,735 | 6/1987 | DuBois et al. | 271/116 X |
| 4,796,035 | 1/1989 | Kawasaki et al. . | |
| 5,106,071 | 4/1992 | Graham | 271/122 X |

FOREIGN PATENT DOCUMENTS

| | | | |
|---|---|---|---|
| 218342 | 9/1987 | Japan | 271/122 |
| 139842 | 6/1988 | Japan | 271/122 |
| 60530 | 3/1989 | Japan | 271/122 |
| 48341 | 2/1990 | Japan | 271/122 |

*Primary Examiner*—D. Glenn Dayoan

*Attorney, Agent, or Firm*—Fitzpatrick, Cella, Harper & Scinto

[57] ABSTRACT

The present invention provides an automatic sheet feeding apparatus with a separation roller rotated in a sheet feeding direction, a reversible roller abutted against the separation roller and adapted to be rotated in a direction opposite to the sheet feeding direction, a supporting device pivotally provided on a support shaft and adapted to support the reversible roller for movement toward and away from the separation roller, driving force transmitter for transmitting a driving force to the reversible roller, and a interruption device provided in the driving force transmitter and adapted to interrupt the transmission of the driving force in response to a load. The driving force transmitting means generates a force acting in a direction that the reversible roller is separated from the separation roller by the transmitting driving force, and the support shaft for the supporting device is so positioned as to generate a force acting in a direction that the reversible roller is urged against the separation roller by a friction force that the reversible roller has received from the separation roller.

23 Claims, 11 Drawing Sheets

AUTOMATIC SHEET FEEDING APPARATUS

BACKGROUND OF THE INVENTION

1. Field of the Invention

The present invention relates to an automatic sheet feeding apparatus of reversible roller type for separating and feeding originals or recording sheets one by one in a facsimile, copying machine, printer and the like.

2. Related Background Art

In the past, sheet feeding apparatuses which comprise a separation roller rotated in a sheet feeding direction, and a reversible roller urged against the separation roller and wherein stacked sheets are separated and fed out one by one are already known.

Normally, in such an automatic sheet feeding apparatus of reversible roller type, a torque limiter is arranged in a drive mechanism for the reversible roller so that, when a plurality of sheets are pinched between the separation roller and the reversible roller, the reversible roller is rotated in a reverse direction to return sheets other than a sheet to be fed forwardly back, and, when a single sheet is pinched between the separation roller and the reversible roller, the drive connection to the reversible roller is interrupted by the torque limiter, thereby rotating the reversible roller by the rotation of the separation roller.

In the automatic sheet feeding apparatus having the reversible roller of this kind, as disclosed in U.S. Pat. No. 4,368,881 and the like, when a driving force is applied to the reversible roller, the force acts in a direction that the reversible roller is urged against the separation roller. With this arrangement, since the urging force between the separation roller and the reversible roller can be automatically adjusted in response to the strength of a limit value of the torque limiter, the separating ability and feeding ability for the sheet are stabilized. That is to say, even when the limit value of the torque limiter becomes greater than a setting value due to the dispersion in the manufacture of the torque limiter, since the urging force between the separation roller and the reversible roller is also automatically increased to increase the separating force for the sheets, the separating ability is not worsened, thus providing the stable sheet separation.

However, in the sheet feeding apparatus wherein the urging force is automatically adjusted, the following problems arise.

That is to say, in such sheet feeding apparatus, when the driving force is applied to the reversible roller, not only the force acts in the direction that the reversible roller is urged against the separation roller, but also a force generated by a friction between the reversible roller and the separation roller acts in a direction that the reversible roller is urged against the separation roller. Thus, when the limit value of the torque limiter becomes greater than the setting value, the urging force tends to become too great. If the urging force is too great, a braking force of the sheet increases considerably, with the result that a feed roller disposed at a downstream side of a separating station is subjected to be greater load, thereby causing the poor feeding (slip) due to the less feeding force of the feeding roller.

The most simple conventional way to solve this problem is that the feeding force of the feed roller is previously set to have a value greater enough to the expected maximum load to be applied thereto. In this case, however, since the torque margin must be estimated excessively in consideration of the maximum sliding friction acting on bearings supporting roller shafts, the manufacturing cost of the apparatus is increased.

The present invention aims to solve these conventional problems.

SUMMARY OF THE INVENTION

The present invention provides a sheet feeding apparatus comprising a separation roller rotated in a sheet feeding direction, a reversible roller abutted against the separation roller and adapted to be rotated in a direction opposite to the sheet feeding direction, a supporting means pivotally provided on a support shaft and adapted to support the reversible roller for movement toward and away from the separation roller, a driving force transmitting means for transmitting a driving force to the reversible roller, and an interruption means provided in the driving force transmitting means and adapted to interrupt the transmission of the driving force in response to a load.

Whereby, the driving force transmitting means generates a force acting in a direction that the reversible roller is separated from the separation roller by the transmitting driving force, and the support shaft for the supporting means is so positioned as to generate a force acting in a direction that the reversible roller is urged against the separation roller by a friction force that the reversible roller is received from the separation roller.

With this arrangement, by balancing the force generated by the driving force and acting in the direction that the reversible roller is separated from the separation roller with the force generated by the friction force and acting in the direction that the reversible roller is urged against the separation roller, even when a limit value of the interruption means (torque limiter) is varied, the urging force between the reversible roller and the separation roller does not become too great or too small, thus providing the optimum urging force to effect the good sheet separation. Further, since the urging force is properly adjusted, a sheet feeding means disposed at a downstream side in the sheet feeding direction is not subjected to the excessive load.

Further, the present invention provides a sheet feeding apparatus comprising a separation roller rotated in a sheet feeding direction, a reversible roller abutted against the separation roller and adapted to be rotated in a direction opposite to the sheet feeding direction, a first supporting means pivotally provided on a support shaft and adapted to support the reversible roller for movement toward and away from the separation roller, a sheet feed roller disposed at a downstream side of the separation roller and adapted to be rotated in the sheet feeding direction, a pinch roller abutted against the sheet feed roller and adapted to be rotated in the sheet feeding direction, a second supporting means pivotally provided on the same support shaft and adapted to support the pinch roller for movement toward and away from the sheet feed roller, a driving force transmitting means for transmitting a driving force to the reversible roller and the pinch roller, and an interruption means provided in the driving force transmitting means and adapted to interrupt the transmission of the driving force in response to a load.

Whereby, the driving force transmitting means generates a force acting in a direction that the reversible roller is separated from the separation roller and a force acting in a direction that the pinch roller is urged against the sheet feed roller by the transmitting driving force, and the support shaft is so positioned as to generate a force acting in a direction that the reversible roller is urged against the separation roller by a friction force that the reversible roller is received from the separation roller.

With this arrangement, even when a limit value of the interruption means (torque limiter) is varied, since the urging force between the sheet feed roller and the pinch roller is adjusted accordingly, the optimum urging force can be obtained, thus preventing the poor sheet feeding. Further, it is not needed to previously set a feeding force of the sheet feed roller excessively.

DETAILED DESCRIPTION OF THE PREFERRED EMBODIMENTS

Figure 1:
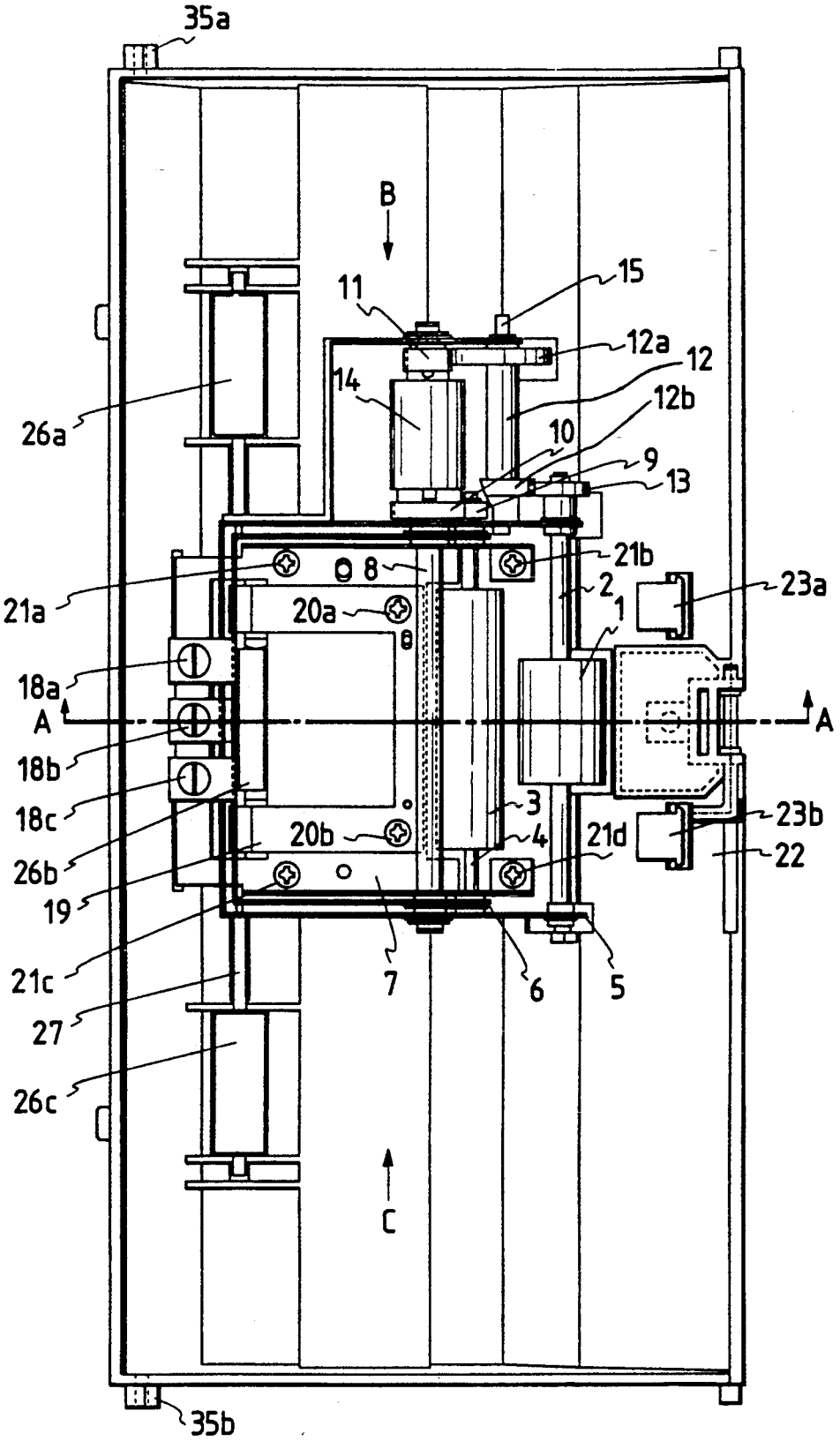
FIG. 1 is a plan view of an automatic sheet feeding apparatus according to the present invention.
Figure 2:
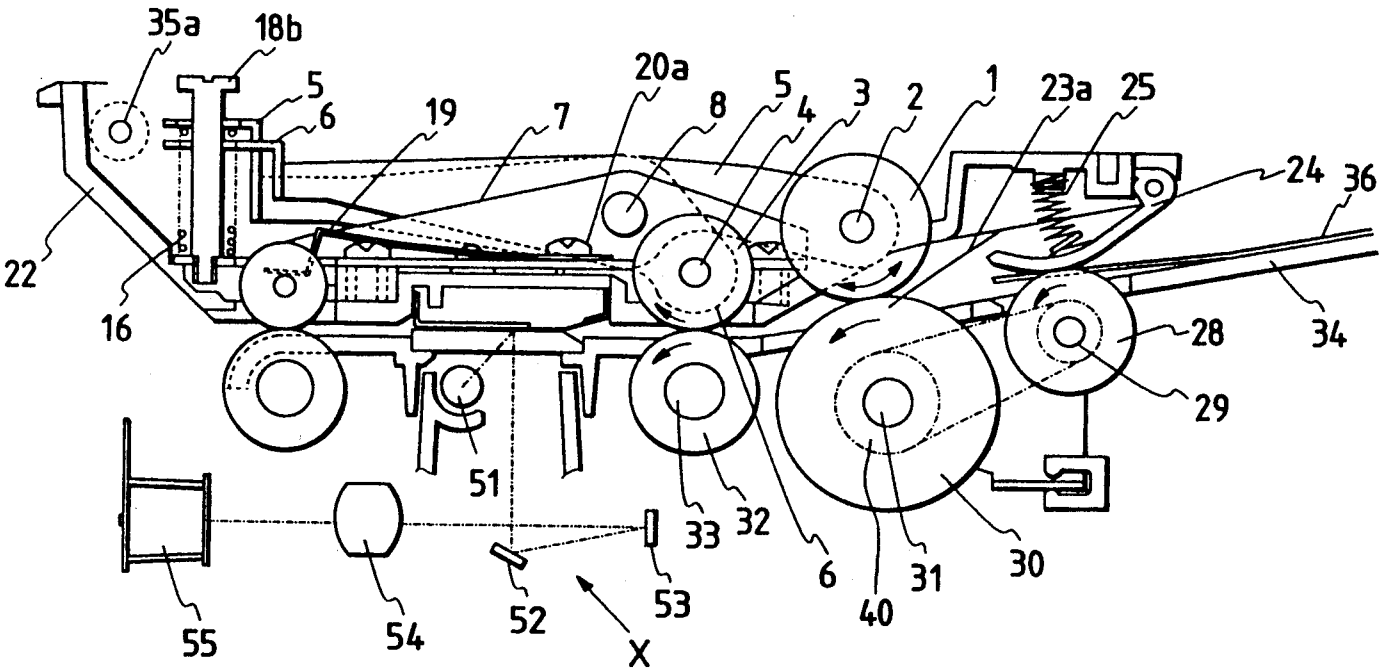
FIG. 2 is a sectional view taken along the line A—A in FIG. 1.
Figure 3:
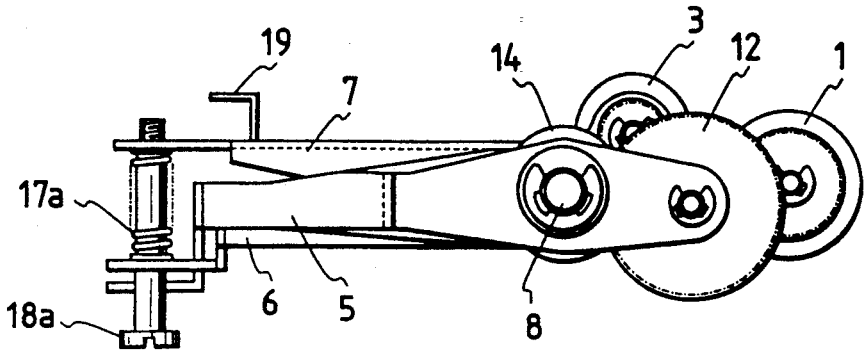
FIG. 3 is a view looked at from a direction shown by the arrow B in FIG. 1.
Figure 4:
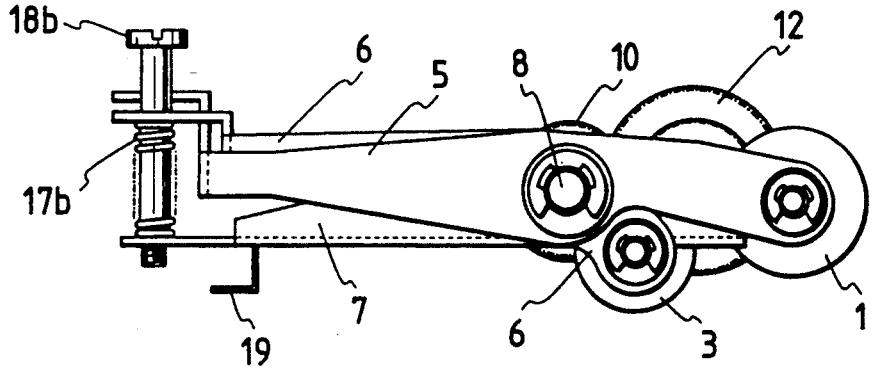
FIG. 4 is a view looked at from a direction shown by the arrow C in FIG. 1.

FIG. 1 is a plan view of a facsimile system to which the present invention is applied, schematically showing a portion that an original sheet is led to an image reading station X, FIG. 2 is a partial sectional view taken along the line A—A in FIG. 1, FIG. 3 is a view looked at from a direction shown by the arrow B in FIG. 1 illustrating a main portion, and FIG. 4 is a view looked at from a direction shown by the arrow C in FIG. 1 illustrating a main portion.

In FIGS. 1 to 4, the reference numeral 1 denotes a reversible roller; 2 denotes a roller shaft of the reversible roller; 3 denotes a pinch roller made of EPDM having high coefficient of friction; 4 denotes a roller shaft of the pinch roller; 5 denotes a reversible roller holder for holding the roller shaft 2 of the reversible roller via bearings; and 6 denotes a pinch roller holder for holding the roller shaft 4 of the pinch roller via bearings.

The reference numeral 7 denotes a frame; 8 denotes a support shaft through the reversible roller holder 5 and the pinch roller holder 6 are rotatably mounted on the frame 7; 9, 10, 11, 12*a*, and 12*b* and 13 denote gears for transmitting a driving force from the pinch roller shaft 4 to the reversible roller shaft 2 and having the number of teeth of 16, 33, 22, 47, 29 and 27, respectively.

The reference numeral 14 denotes a torque limiter; 15 denotes a rotary support shaft for gears 12*a*, 12*b*, provided on the reversible roller holder 5; 16 denotes a reversible roller spring for biasing the reversible roller 1 via the reversible roller holder 5; 17*a* and 17*b* denotes pinch roller springs for biasing the pinch roller 3 via the pinch roller holder 6; 18*a*, 18*b* and 18*c* denote stoppers for limiting the rotations of the reversible roller holders 5 and the pinch roller holders 6; and 19 denotes a leaf spring attached to the frame 7 via screws 20*a*, 20*b* and adapted to bias rollers 26*a*, 26*b*, 26*c* via a roller shaft 27.

The gear 9 is secured to the pinch roller shaft, and the gears 10, 11 are rotatably mounted on the support shaft 8. The torque limiter 14 is disposed between the gears 10 and 11 and is engaged by these gears 10, 11. Incidentally, the support shaft 8 passes through the torque limiter 14 and is not fixed to the latter. The gears 12*a* and 12*b* are integrally formed via a boss portion 12 and are rotatably mounted on the rotary support shaft 15. The gear 13 is secured to the reversible roller shaft 2. Through a gear train constituted such elements, the rotation of the pinch roller 3 is transmitted to the reversible roller 1.

The above-mentioned elements designated by the reference numerals 1 to 20 constitutes an independent unit (referred to as "reversible roller unit" hereinafter) which is attached to an upper original guide 22 by screws 21*a*, 21*b*, 21*c* and 21*d*.

Further, the reference numeral 23*a* and 23*b* denote guides made of low rigid members and disposed at left and right sides of the reversible roller; 24 denotes an urging arm; 25 denotes an urging arm spring for urging the urging arm against a pre-feed roller 28. The above-mentioned elements designated by the reference numerals 1 to 27 constitutes a unit (referred to as "upper original guide unit" hereinafter) in which the reversible roller unit is attached to the upper original guide 22.

The reference numeral 29 denotes a pre-feed roller shaft for rotatably supporting the pre-feed roller 28; 30 denotes a separation roller; 31 denotes a separation roller shaft; 32 denotes a sheet feed roller made of butyl-rubber having a coefficient of friction smaller than that of the pinch roller 3; 33 denotes a feed roller shaft; and 34 denotes a lower original guide serving as a sheet support. Further, the upper original guide unit is pivotally mounted on a body frame (not shown) of a facsimile system via pins 35*a*, 35*b* formed on the upper original guide 22 and is normally maintained at a predetermined height with respect to the lower original guide 34 by a locking means (not shown).

Figure 5:
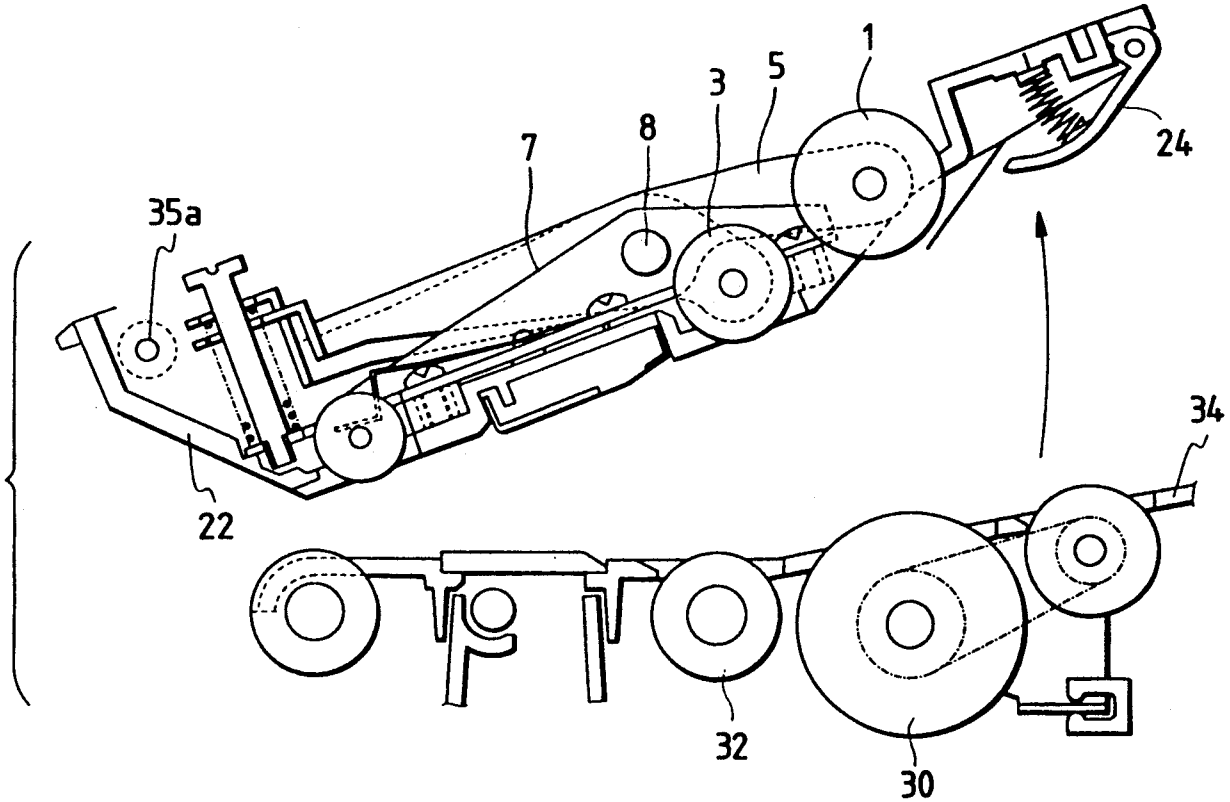
FIG. 5 is an elevational view of a portion of the apparatus of FIG. 1, showing a condition that an upper original guide is opened or elevated.

When the locking means is released, as shown in FIG. 5, the upper original guide unit can be lifted. To the contrary, when the upper original guide unit is lowered and the locking means is locked, the reversible roller 1 and the pinch roller 3 are abutted against the separation roller 30 and the feed roller 32, respectively, thus forming an ADF (automatic document feeder) of reversible roller type. Incidentally, the reference numeral 36 denotes a sheet (original or document).

The separation roller 30 and the feed roller 32 are rotated in directions shown by the arrows in FIG. 2 by means of a drive source (not shown). Further, the torque limiter 14 is so designed that it is slipped when the reversible roller 1 is subjected to a load greater than a setting value TR. Further, it is so designed that, when frictional forces between the rollers and between the rollers and the sheet are F1–F7, i.e., F1 = frictional force between reversible roller 1 and separation roller 30, F2 = frictional force between pinch roller 3 and feed roller 32, F3 = frictional force between reversible roller 1 and sheet 36, F4 = frictional force between separation roller 30 and sheet 36, F5 = frictional force between two sheets 36, F6 = frictional force between pinch roller 3 and sheet 36, F7 = frictional force between feed roller 32 and sheet 36, and radii of the reversible roller 1 and pinch roller 3 are r1 and r2, respectively, and a reduction ratio of the gear train from the pinch roller 3 to the reversible roller 1 is 0, the following relations are obtained by the above frictional forces, and forces of the reversible roller spring 16 and pinch roller springs 17*a*, 17*b*:

$$F1 \cdot r1 > TR \quad \text{(i)}$$

$$F3 \cdot r1 > TR\ F5 \cdot r1 \quad \text{(ii)}$$

$$F4 > F5 \quad \text{(iii)}$$

$$\eta F2 \cdot r2 > TR \quad \text{(iv)}$$

$$\eta F6 \cdot r2 > TR \quad \text{(v)}$$

$$\eta F7 \cdot r2 > TR \quad \text{(vi)}$$

Thus, the ADF of reversible roller type having the torque limited are operated as follows, in accordance with the sheet originals 36 set on the lower original guide 34:

(1) In case of no sheet

On the basis of the above relations (i) and (iv), the reversible roller 1 and pinch roller 3 are rotated by the rotations of the separation roller 30 and feed roller 32, respectively, and the torque limiter 14 is slipped.

(2) In case of a single sheet

On the basis of the above relations (ii) ($F3 \cdot r1 > TR$), (v) and (vi), the reversible roller 1 and pinch roller 3 are rotated by the rotations of the separation roller 30 and feed roller 32, respectively, via the sheet, and the torque limiter 14 is slipped (same operation as the above (1)).

(3) In case of two or more sheets

On the basis of the above relations (ii), (iii), (v) and (vi), the pinch roller 3 is rotated by the rotation of the feed roller 32 via the sheet, and the reversible roller 1 is rotated reversely to return sheets other than a lowermost sheet back toward a direction opposite to a sheet feeding direction. The torque limiter does not slip.

Figure 6:
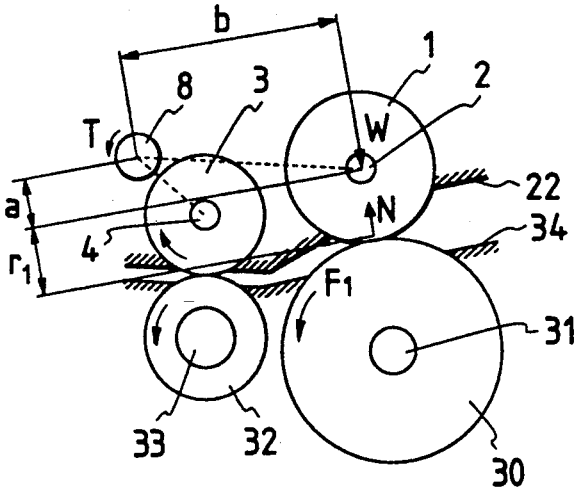
FIG. 6 is a view for explaining forces acting on a reversible roller of the apparatus of FIG. 1.

Now, an automatic adjusting operation for the urging force of the reversible roller will be fully explained with reference to FIG. 6. FIG. 6 shows only a main portion associated with the rollers. In FIG. 6, T indicates a torque required when the gear 11 drives the gear 12. When the reduction ratio from the gear 11 to the gear 13 via the gear 12 is $\eta 1$, the following relation (1) is obtained:

$$T = \frac{1}{\eta 1} TR \quad (1)$$

F1 indicates a frictional force that the reversible roller 1 is received from the separation roller 30; W indicates an urging force given by the reversible roller spring 16; N indicates a normal drag or reaction force that the reversible roller 1 is received from the separation roller 30; a indicates a distance from a centerline of the support shaft 8 to a plane passing through a centerline of the reversible roller shaft 2 and extending in parallel with a tangential line between the reversible 1 and the separation roller 30; and b indicates a distance from the centerline of the support shaft 8 to a plane passing through centerlines of the reversible roller shaft 2 and of the separation roller shaft 31.

Now, it is assumed that the separation roller 30 is rotated in a direction shown by the arrow in FIG. 6 to generate the frictional force F1, the reversible roller 1 is rotated by the rotation of the separation roller 30 as mentioned above and the torque limiter is slipped. In this condition, the force F1 tends to rotate the reversible roller 1 in an clockwise direction with respect to the support shaft 8 (in a direction that the reversible roller is urged against the separation roller 30) with a torque F1 (r1+a), and the gear 11 tends to rotate the reversible roller 1 in an anti-clockwise direction with respect to the support shaft 8 (in a direction that the reversible roller is separated from the separation roller 30) with a torque $$T = \frac{1}{\eta 1} TR \quad (2)$$

Thus, the balance around the support shaft 8 of the reversible roller 1 becomes as follows:

$$(N - W)b - F1(r1 + a) + \frac{1}{\eta 1} TR = 0 \quad (3)$$

Accordingly, the normal reaction force N becomes $$N = W + F1 \frac{r1 + a}{b} - \frac{1}{\eta 1 b} TR \quad (4)$$

Now, since $F1 = 1/r1 \times TR$, when this value is added to the above equation to disappear F1, the following equation is obtained:

$$N = W + \left( \frac{r1 + a}{r1 \cdot b} - \frac{1}{\eta 1 \cdot b} \right) TR \quad (5)$$

This equation (5) indicates the actual urging force N between the reversible roller 1 and the separation roller 30 (during the operation of the rollers). As apparent from right two terms in the equation (5), if the value TR varies, the urging force N will be also varied. In the illustrated embodiment, when r1=1 cm, a=0.4 cm, b=3.1 cm, and $\eta 1 = 47/22 \times 27/29 = 2.0$, the following relation can be obtained:

$$\begin{aligned} \frac{\Delta N}{\Delta TR} &= \frac{r1 + a}{r1 \cdot b} - \frac{1}{n1 \cdot b} \\ &= \frac{1 + 0.4}{1 \times 3.1} - \frac{1}{2.0 \times 3.1} \\ &= 0.45 - 0.16 \\ &= 0.29\ \text{cm}^{-1} \end{aligned} \quad (6)$$

In the above equation (6), the first term $$\frac{r1 + a}{r1 \cdot b}$$

(positive or plus) indicates the force that the friction force of the reversible roller 1 received from the separation roller 30 acts in the direction that the reversible roller 1 is urged against the separation roller 30, and the second term $$-\frac{1}{\eta 1 \cdot b}$$

(negative or minus) indicates the fact that the driving force transmitting from the support shaft 8 (gear 11) to the driving force transmitting means acts in the direction that the reversible roller 1 is separated from the separation roller 30. If this second term is positive, i.e., the driving force transmitted from the support shaft 8 (gear 11) to the driving force transmitting means acts in the direction that the reversible roller 1 is urged against the separation roller 30, the following relation is established:

$$\frac{\Delta N}{\Delta TR} = \frac{r1 + a}{r1 \cdot b} + \frac{1}{\eta 1 \cdot b} = 0.45 + 0.16 = 0.61\ \text{cm}^{-1} \quad (7)$$

Thus, the value $$\frac{\Delta N}{\Delta TR}$$

will become greater than that in the above equation (6). In any case, such value $$\frac{\Delta N}{\Delta TR}$$

is positive (plus), even if the torque limit value TR of the torque limiter 14 is varied due to the dispersion in the manufacture of the limiter, the value N is automatically adjusted accordingly. Thus, the normal separation operation can be achieved within a wider range of the torque limit value TR.

However, as mentioned above, if the torque limit value TR and the normal reaction force N are too great, since the poor sheet feeding will occur, the actually available range of the torque limit value TR has a certain upper limit.

Figure 7:
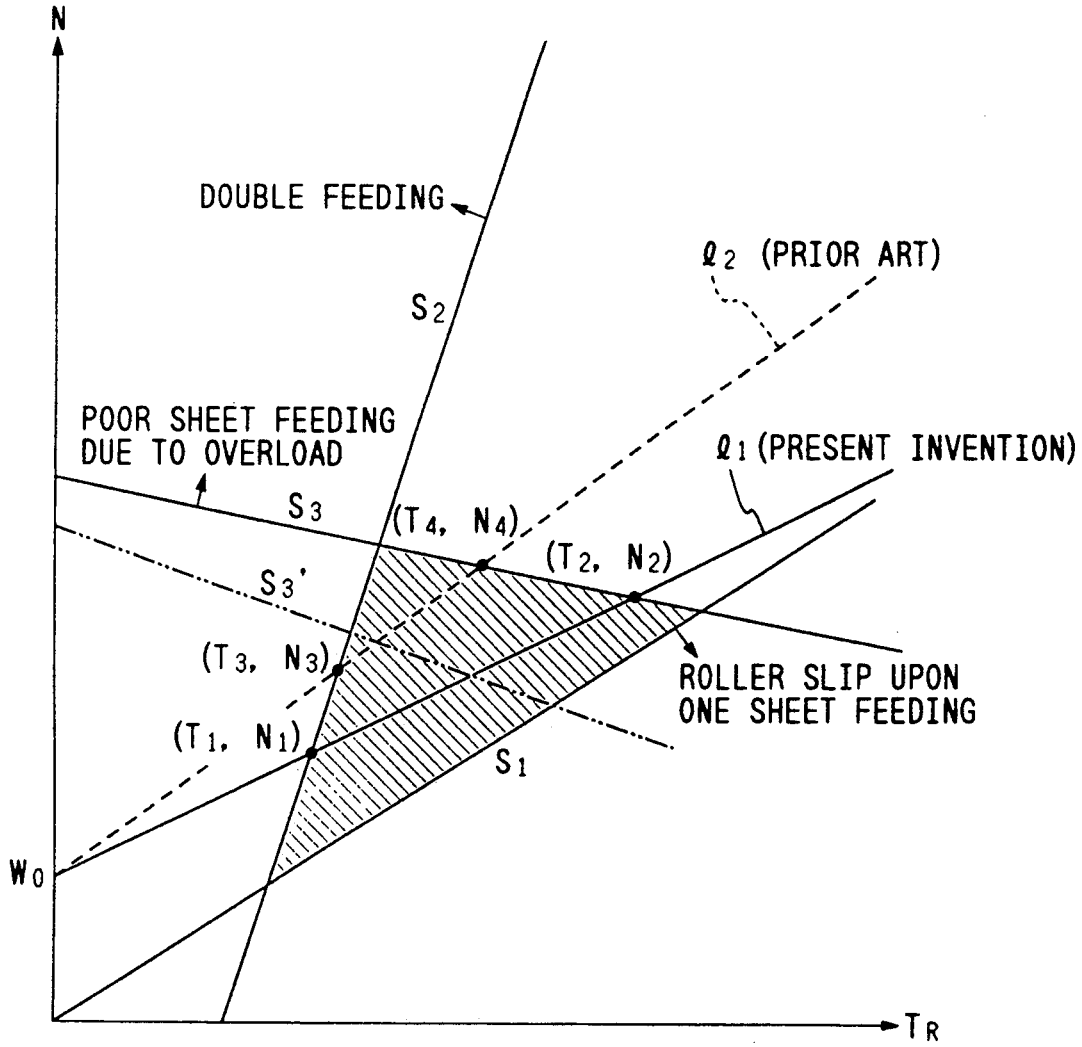
FIG. 7 is a graph showing a range relation between a torque value TR and a force N, which can separate and feed a sheet properly.

Such relation will be explained with reference to FIG. 7. FIG. 7 is a graph showing range of values TR and N which permits the proper separation and sheet feeding. In FIG. 7, a zone at a right side of a straight line S1 is an area where the roller is slipped upon one sheet feeding due to be insufficiency of N, a zone at a left side of a straight line S2 is an area where the double feeding occurs due to the insufficiency of TR, and Wo is a minimum required value of the urging force of the reversible roller 1 during the inoperative condition of each roller (a value below which the reversible roller 1 is floated upon setting of the sheets). A zone at an upper side of a straight line S3 is an area where the value N becomes too great (overload) to cause the poor sheet feeding. A hatched area encircled by the straight lines S1, S2 and S3 indicates the range of values TR and N which permits the proper separation and sheet feeding.

In FIG. 7, the aforementioned relation between the values TR and N ((5), (6)) according to the present invention is indicated by a straight line l1. As can be seen from FIG. 7, a value range from T1 to T2 can be used as a value of TR. On the other hand, the relation obtained from the above equation (7)) is indicated by a straight line l2 having a greater inclination than the line l1. In this case, merely a value range from T3 to T4 can be used as a value of TR. That is to say, by realizing the relation shown by the line l1, the available range of the torque limiter 14 can be extended rom (T4−T3) to (T2−T1). Further, if desired, by varying or altering the values r1, a, b and $\eta 1$, the value $$\frac{\Delta N}{\Delta TR}$$

may be easily adjusted.

Figure 8:
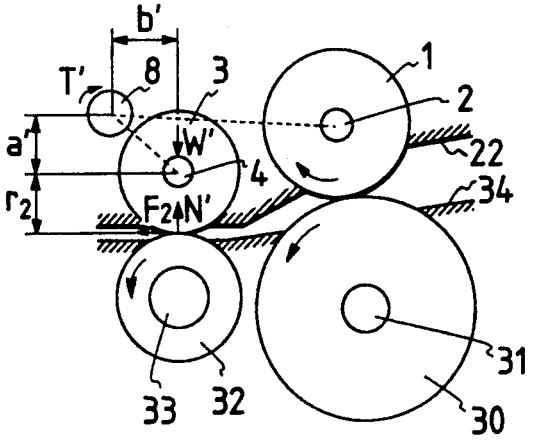
FIG. 8 is a view for explaining forces acting on a pinch roller of the apparatus of FIG. 1.

Next, the operation of the present invention, i.e., an operation for automatically adjusting the urging force of the pinch roller 3 will be explained with reference to FIG. 8. FIG. 8 is a view similar to FIG. 6, but showing the balance between forces (moments) around the pinch roller 3. In FIG. 8, T′ is a loading torque of the gear 10 acting on the gear 9, i.e., "torque that the gear 10 drives the gear 9" when the drive transmission from the pinch roller 3 to the reversible roller 1 is seen reversely. Thus, this T′ is referred to as "reverse drive transmission torque". T′ has the same value as the aforementioned T, but acts in a direction opposite to T. That is to say, $$T' = -T = -\frac{1}{\eta 1} TR \quad (8)$$

F2 is a friction force that the pinch roller 3 is received from the sheet feed roller 32; W′ is an urging force given by the pinch roller springs 17*a* and 17*b;* N′ is a normal reaction force that the pinch roller 3 is received from the feed roller 32; a′ is a distance from a centerline of the support shaft 8 to a plane passing through a centerline of the pinch roller shaft 4 and extending in parallel with a tangential line between the pinch roller 3 and the feed roller 32; and b′ is a distance from the centerline of the support shaft 8 to a plane passing through centerlines of the pinch roller shaft 4 and the feed roller shaft 33.

Similar to the explanation of the automatic adjustment of the urging force of the reversible roller, it is assumed that the feed roller 32 and the separation roller 30 are driven and the pinch roller 3 and the reversible roller 1 are rotated by the rotation of the rollers 32, 30 and the torque limiter 14 is being slipped. In this condition, the force F2 tends to rotate the pinch roller 3 in a clockwise direction with respect to the support shaft 8 (in a direction that the pinch roller is urged against the feed roller 32) with a torque F2 (r2+a'), and the gear 10 tends to rotate the pinch roller in an anti-clockwise direction (in a direction that the pinch roller is separated from the feed roller 32) with a torque $$|T'| = \frac{1}{\eta 1} TR \quad (9)$$

Thus, the balance around the support shaft 8 of the pinch roller 3 becomes as follows:

$$(N' - W')b' - F2(r2 + a') - \frac{1}{\eta 1} TR = O \quad (10)$$

Accordingly, the normal reaction force N' becomes $$N' = W' + F2\frac{r2 + a'}{b'} + \frac{1}{\eta 1 b'} TR \quad (11)$$

Now, since F2=1/r2×TR/η, when this value is added to the above equation to disappear F2, the following equation is obtained:

$$N' = W' + \left(\frac{r2 + a}{\eta r2 b'} + \frac{1}{\eta 1 b'}\right)TR \quad (12)$$

This equation (12) indicates the actual urging force N' between the pinch roller 3 and the feed roller 32 (during the operation of the rollers). Similar to the equation (5) indicating the urging force of the reversible roller 1, if the value TR varies, the urging force N' will be also varied. In the illustrated embodiment, since r2=0.8 cm, a'=0.8 cm, b'=0.95 cm, 1=2.0, and $$\eta = \frac{33}{16} \times \frac{47}{22} \times \frac{27}{29} = 4.1$$

the following relation can be obtained:

$$N' = W' + \left(\frac{r2 + a'}{\eta r2 b'} + \frac{1}{\eta 1 b'}\right)TR \quad (13)$$

$$\begin{aligned} \frac{\Delta N'}{\Delta TR} &= \frac{r2 + a'}{\eta r2 b'} + \frac{1}{\eta 1 b'} \\ &= \frac{0.8 + 0.8}{4.1 \times 0.8 \times 0.95} + \frac{1}{2.0 \times 0.95} \\ &= 0.513 + 0.526 \\ &= 1.04\ \text{cm}^{-1} \end{aligned} \quad (14)$$

Thus, the automatic adjustment is effected in such a manner that, when the value TR becomes greater to increase the sheet returning force of the reversible roller 1, the urging force N' of the pinch roller 3 is also increased to increase the feeding force of the feed roller 32. In this way, the normal (no reduction in the feeding speed) feeding operation can be attained with a wider range of the value TR.

Figure 9:
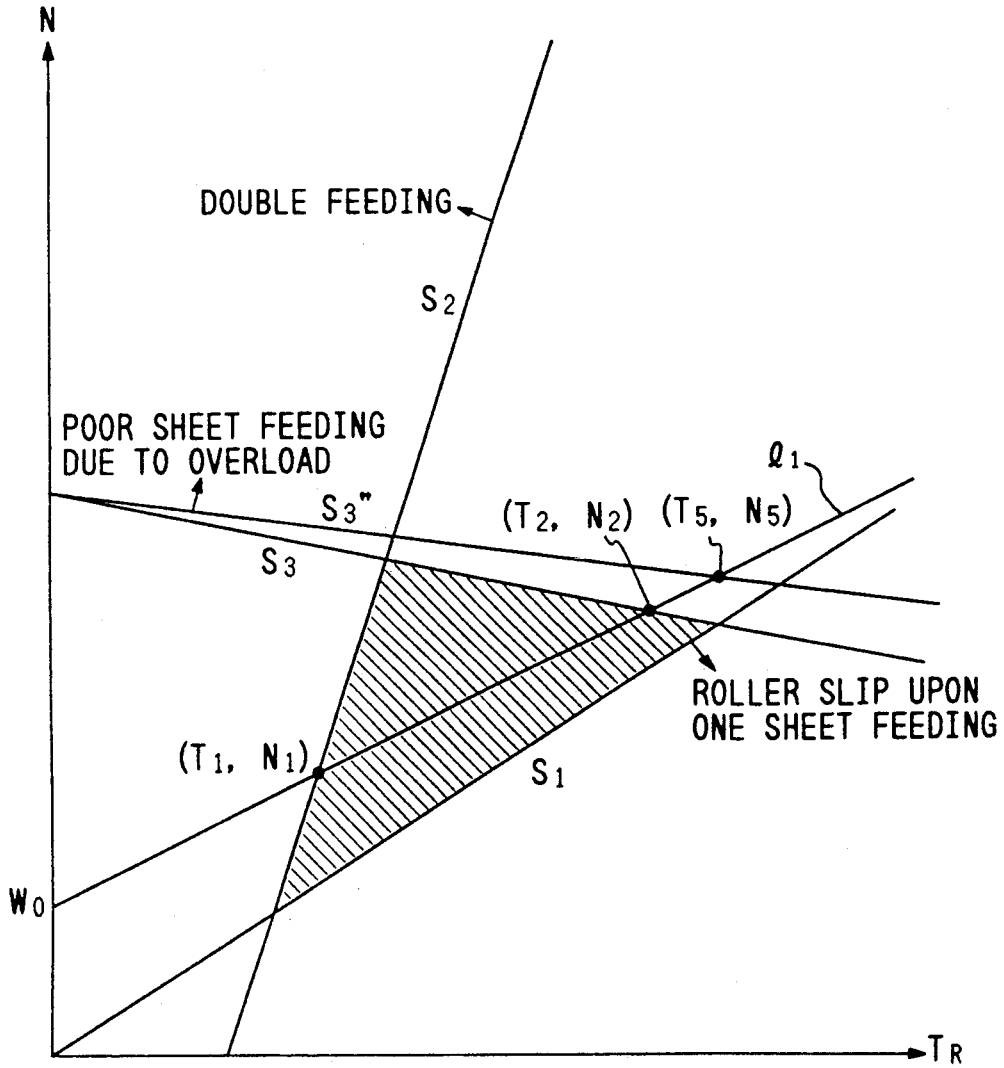
FIG. 9 is a graph showing a range relation between a torque value TR and a force N, which can separate and feed a sheet properly.

Such relation will be explained with reference to FIG. 9. FIG. 9 is a graph wherein a straight line S3'' indicating the effect of the present invention is added to the graph of FIG. 7. According to the present invention, since, the value TR can be more greater, the urging force N' of the pinch roller becomes greater to increase the upper limit for the poor sheet feeding due to the overload, i.e., to increase the permitable upper limit of the urging force N of the reversible roller, the straight line S3 defining the area of the poor sheet feeding due to the overload is altered to a straight line S3'', thereby changing the available upper limit value of the torque limiter 14 from T2 to T5.

That is to say, according to the present invention, the available range of the torque limiter 14 can be extended from (T2−T1) to (T5−T1). Further, if desired, by varying or altering the values r2, a', b', η1 and η, the value $$\frac{\Delta N'}{\Delta TR}$$

may be easily adjusted.

In the automatic sheet feeding apparatus, while a large number of sheets are fed, paper powder and/or ink from the printed matter are sometimes adhered to the rollers to decrease the coefficients of friction of the rollers, thereby causing the trouble. Particularly, if the coefficient of friction of the sheet feed roller 32 is decreased, the poor sheet feeding speed will occur. Explaining this with reference to FIG. 7, this poor sheet feeding speed corresponds the fact that, if the straight line S3 is changed to as a straight line S3' in FIG. 7, for example, the area (hatched area) of the values TR and N where the normal sheet separation and sheet feeding can be permitted becomes narrower.

In the present invention, the material of the feed roller 32 is changed not to adhere the paper powder and the like to this roller, thereby making the coefficient of friction of the pinch roller 3 to become greater than that of the feed roller 32, so that the feed roller 32 is cleaned by the pinch roller 3. In this way, the area where the normal sheet separation and sheet feeding can be permitted is prevented from becoming narrower, thus maintaining the initial performing ability for a long time without changing or cleaning the feed roller 32.

Incidentally, in the illustrated embodiment, since the reversible roller 1 and the separation roller 30 are made of the same silicone rubber, the variation of the value F1 is small, thereby facilitating the control of the above condition (i), and also facilitating the above conditions (ii), (iii) due to F3=F4. Further, since the silicone rubber has the property that the coefficient of friction thereof is less reduced by the silicone oil adhered to the recording sheet and the like, the recording sheets to which the silicone oil is adhered can be stably fed.

Further, even when the sheet is curled by the guides 23*a*, 23*b*, such sheet can be fed without folding a leading end of the sheet. In addition, since the reversible roller 1 is driven by the pinch roller 3 and is constructed as the reversible roller unit independently, as mentioned above, the upper original guide unit can be easily released, and the manufacturing cost is low, the possibility of the failure is also low and the changeability of the unit is improved due to the simple mechanism.

Furthermore, in the illustrated embodiment, while the rollers were made of different rubber material to become the coefficient of friction of the pinch roller 3 greater than that of the feed roller 32, the rollers may be made of the material of the same kind but having different hardness. Generally, the rubber has the property that the lower the hardness the greater the coefficient of friction regarding the same kind. Thus, by utilizing this property, the pinch roller is made of rubber material having the lower hardness than the rubber of the feed roller 32 to become the coefficient of friction of the former greater than that of the latter.

Figure 10:
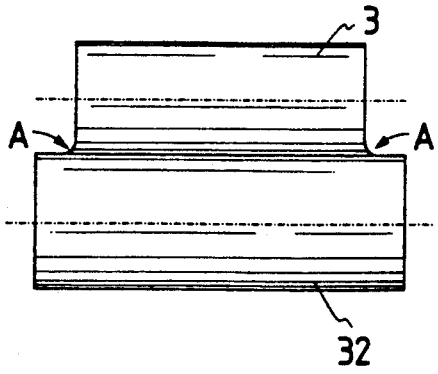
FIG. 10 is a view showing an abutting relation between a pinch roller and a sheet feed roller.
Figure 11:
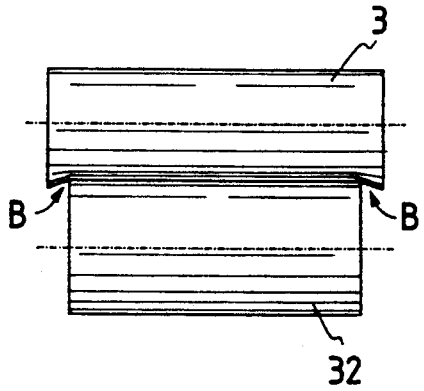
FIG. 11 is a view showing an abutting relation between a pinch roller and a sheet feed roller, according to another example.

In this case, (a) since the feed roller 32 which requires the more greater feeding accuracy is harder than the pinch roller, the feed roller is difficult to deform (deformation of a diameter thereof), thus making the occurrence of the poor feeding, and (b) since these rollers are made of rubber material of the substantially the same kind, the change in the property such as hardness are similar as the time goes, and, therefore, the initial balance between the coefficients of friction of these rollers is hard to be changed. Further, in this case, when the a width of the pinch roller 3 having the smaller hardness is narrower than the feed roller 32, since the deformation of the pinch roller at a contacting area between the pinch roller 3 and the feed roller 32 occurs along the feed roller 32 as shown portions A in FIG. 10, the sheet being fed is not shrinked. If the width of the pinch roller 3 having the smaller hardness is greater than the feed roller 32, as shown in FIG. 11, both ends of the feed roller 32 penetrate into the pinch roller 3 to generate steps, thus shrinking the sheet.

Incidentally, in the illustrated embodiment, the image reading portion x comprises a light source 51, reflection mirrors 52, 53, a lens 54, and a photoelectric converter element 55 such as a CCD, as shown in FIG. 2.

Next, a second embodiment of the present invention will be explained.

As apparent from the above equations (13), (14), in the aforementioned embodiment, the force $1/\eta 1 \cdot b'$ TR generated in the direction that the reverse driving force transmitted from the support shaft 8 to the pinch roller 3 urges the pinch roller 3 against the feed roller 32, and the force $$\frac{r2 + a'}{\eta r2b'} TR$$

generated in the direction that the friction force of the pinch roller 3 received from the feed roller 32 urges the pinch roller 3 against the feed roller 32 were both positive (plus) to make the combination force positive, either of these forces may be zero or negative so long as the combination force becomes positive. In this case, the same technical effect as that of the first embodiment can be obtained.

For example, in the aforementioned embodiment, since the support shaft 9 was disposed at a downstream side of the pinch roller 3 in the sheet feeding direction, the force $$\frac{r2 + a'}{\pi r2b'} TR$$

generated by the friction force of the pinch roller 3 was positive. However, so long as the combination force becomes positive, the support shaft 9 may be disposed at an upstream side of the pinch roller 3 even when the force generated by the friction force of the pinch roller 3 becomes negative. In this way, the present invention has a wider degree of freedom in design.

Incidentally, in the illustrated embodiments, while the driving force was transmitted from the feed roller 32 via the pinch roller 3, the driving force may be obtained by connecting the drive source to the gear 10. Further, any kinds of gear train may be used so long as the force is generated in the direction that the reversible roller 1 is separated from the separation roller 30 when the driving force is applied.

Now, the setting of the hardness and configuration of the reversible roller 1 and the separation roller 30 will be explained.

As mentioned above, when two or more sheets are supplied, the reversible roller 1 returns the sheets other than the lowermost sheet back, and the reversible roller 1 is stopped when the sheets are completely returned. The reason is that, as shown FIG. 13, the torque $(F3'+F5')r1$ generated by the combination force $(F3'+F5')$ of the friction force F3' between the sheet 36 and the reversible roller 1 and the friction force F5' between the waiting sheet 37 and the sheet 36 and acting on the reversible roller 1 is balanced with the torque TR biased to the reversible roller 1. The friction force F3' is smaller than the friction force F3 generated when there is no waiting sheet 37, since the contacting area between the sheet 36 and the reversible roller 1 is decreased due to the presence of the waiting sheet 37.

Figure 13:
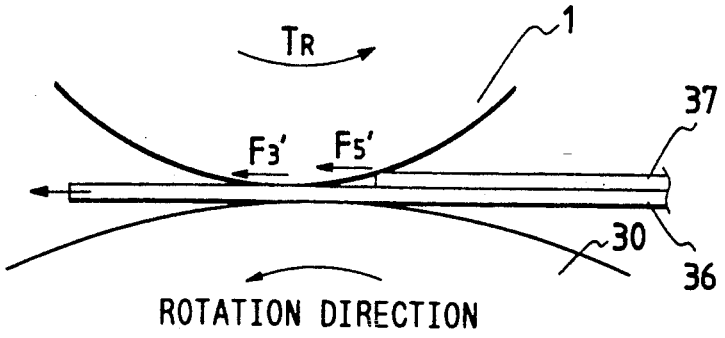
FIG. 13 is a partial sectional view for explaining forces during the separating and feeding of the sheet.

If the waiting sheet 37 further penetrates in the downstream side in comparison with the condition of FIG. 13, since the friction force F3' becomes smaller to provide a relation $(F3'+F5')r1<TR$, the reversible roller 1 is rotated reversely to return the sheet 37. Conversely, if the sheet 37 is returned too great, since the friction force F3' becomes greater to provide a relation $(F3'+F5')r1>TR$, the reversible roller 1 is rotated by the movement of the sheet 36(37), whereby the sheet 36 advances in the downstream side. There is a point of the balance of the forces between these two conditions, thus stopping the reversible roller 1.

A peripheral surface of the reversible roller 1 being stopped wears by the sliding friction force between this roller and the sheet 36 being fed. By repeating the feeding operations of the sheet, since a portion of the peripheral surface of the reversible roller is varied, after all, the peripheral surface of the reversible roller will be uniformly worn.

Figure 16:
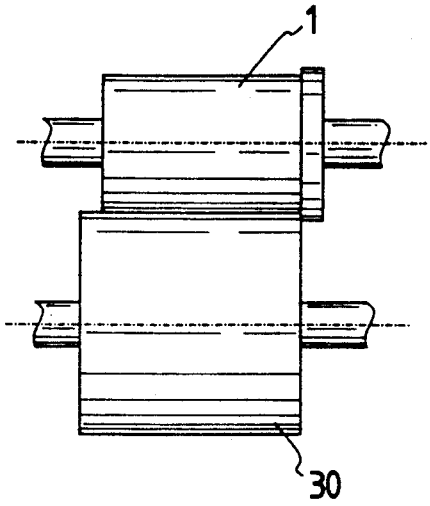
FIG. 16 is a view showing an abutting relation between a reversible roller and a separation roller in a conventional case where the hardness of the reversible roller is smaller than that of the separation roller.
Figure 17:
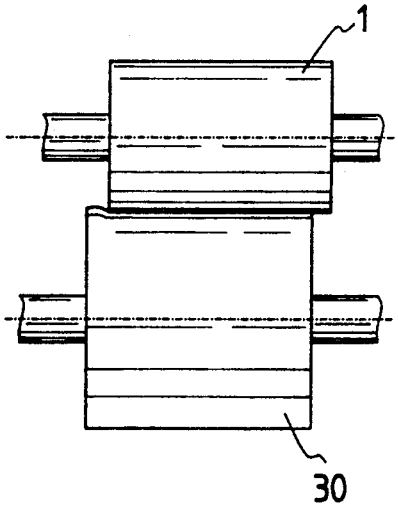
FIG. 17 is a view showing an abutting relation between a reversible roller and a separation roller in a conventional case where the hardness of the reversible roller is greater than that of the separation roller.

Now, it is assumed that the reversible roller 1 has a hardness smaller than that of the separation roller 30 and has a width same as that of the separation roller. Even when the reversible roller has the same width as that of the separation roller, actually, due to the dispersion in dimension of each part in the manufacture process or the play generated in the assembling process, there is no almost case where the widths of both rollers are completely coincided, thus causing the difference more or less. As a result, the contacting portions between the rollers are worn greatly as mentioned above, whereas non-contacting portions are not worn. Consequently, as the number of the fed sheets is increased, as shown in FIG. 16, the reversible roller 1 is locally worn, thus causing the poor separation of the sheets. Conversely, if the reversible roller 1 is harder than the separation roller, as shown in FIG. 17, the separation roller 30 is recessed, thus causing the poor separation or damaging the original.

Figure 12:
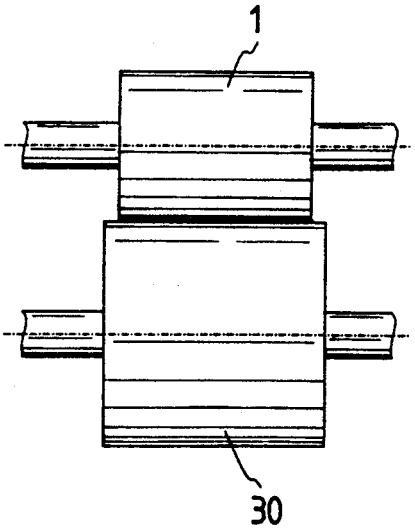
FIG. 12 is a view showing an abutting relation between a reversible roller and a separation roller.

However, when the reversible roller 1 and the separation roller 30 are made of the same material and the width of the reversible roller 1 is greater than that of the separation roller 30 as shown in FIG. 12, the reversible roller 1 is not worn locally or the separation roller 30 is not recessed. Also with this arrangement, although the reversible roller 1 is worn, since the reversible roller is worn uniformly along its length, any trouble such as the poor separation does not occur, thus improving the durability of the apparatus greatly.

In the illustrated embodiments, while the reversible roller 1 and the separation roller 30 were made of the same silicone material, for example, the reversible roller 1 may be made of silicone having the rubber hardness of 30° and the separation roller 30 may be made of EPDM having the rubber hardness of 40°. Generally, regarding the same kind of rubber, as the hardness thereof is decreased, the coefficient of friction thereof increases. Thus, by changing the materials of the rollers, it is possible to become the coefficient of friction of the reversible roller 1 smaller than that of the separation roller 30 while keeping the hardness of the reversible roller smaller (softer) than that of the separation roller. The combination of the silicone and EPDM utilizes the fact that the coefficient of friction of the silicone rubber is smaller than that of EPDM.

The reason why the coefficient of friction of the reversible roller 1 is preferably smaller than that of the separation roller 30 is that the non-sheet feeding trouble due to "jam of leading end" of the sheets can be prevented when a plurality of sheets stacked on a sheet support are supplied.

Figure 14:
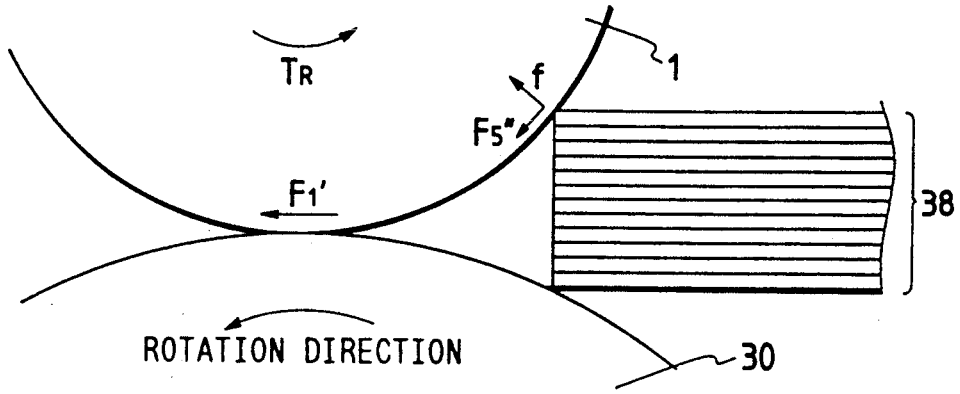
FIG. 14 is a partial sectional view showing a sheet jam condition at a leading end portion of stacked sheets.

The "jam of leading end" of the sheets means a phenomenon that the stacked sheets are pinched ahead of a nip between the reversible roller 1 and the separation roller 30 to prevent the rotation of the reversible roller 1 by the rotation of the separation roller. Explaining this with reference to FIG. 14, the torque generated by the friction force F1' of the reversible roller 1 received from the separation roller 30 and the friction force F5'' received from the sheet stack 38 is balanced with the torque TR biased to the reversible roller 1 (i.e., $(F1'+F5'')r1=TR$). In this case, the reversible roller 1 is subjected to a force f in a direction that the urging force of the reversible roller against the separation roller 30 by the sheet stack 38, and the friction force F1' received from the separation roller 30 is smaller than the friction force F1 received from the separation roller 30 when there is no sheet stack 38. Now, the reason why the term "sheet stack" is used is that, when the plural stacked sheets are pinched ahead of the nip between the reversible roller 1 and the separation roller 30 to increase the compression force between the leading portions of the sheets (reaction force of f), the friction force between the sheets is greatly increased so that the sheets behave as if a single solid body. This tendency is enhanced as the roughness of the surface of the sheet increases and as the humidity in the environment increases.

Figure 15:
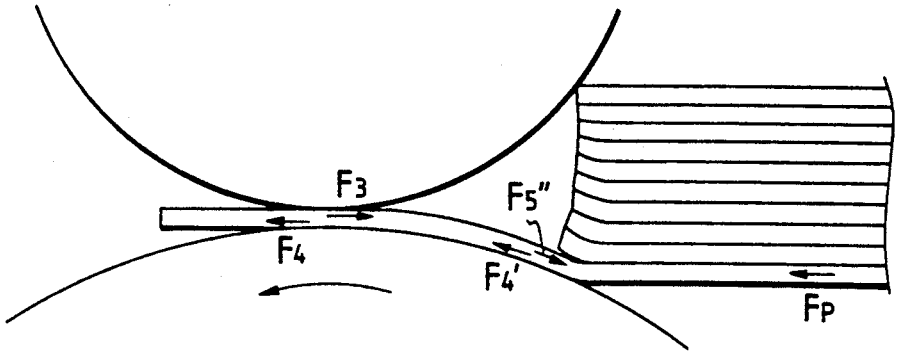
FIG. 15 is a partial sectional view for explaining forces acting on a lowermost sheet while a plurality of sheets are being separated and fed.

In such the "jam of leading ends", is it possible to feed out the lowermost sheet from the sheet stack? In FIG. 15, considering the balance between forces acting on the lowermost sheet 36, when any force acting in a direction that the sheet is fed out is positive, the force acting on the lowermost sheet is as follows:

$$F=(F4-F3)+(F4'-F5'')+Fp \quad (15)$$

Where, Fp is a feeding force given by a pre-feed roller (not shown) disposed at an upstream side of the separation roller 30 and adapted to feed the sheet in the downstream side by contacting with the sheet. Further, F4' is a feeding force given by the separation roller and generated at the "jam of leading ends" position.

From the above equation (15), it is easily understood that there are relations $(F4'-F5'')>0$ (i.e., the fact that the coefficient of friction between the separation roller and the sheet is greater than that between the sheets) and $Fp>0$. In $(F4-F3)>0$, the force F will become positive, so that the lowermost sheet can be fed out. According to the present invention, since the coefficient of friction of the reversible roller 1 is equal to or greater than that of the separation roller 30, the relation $(F4-F3)>0$ can be obtained. Particularly, in the second embodiment, the relation $(F4-F3)>0$ can be clearly established, thus increasing the feeding force to stabilize the feeding ability. If $(F4-F3)<0$, when the total value of the force F is positive, the lowermost sheet can be fed out. However, actually, since the balance of the forces is delicate, the feeding ability is not stabilized, and, thus, $(F4-F3)<0$ is not preferable.

As mentioned above, since the hardness of the reversible roller 1 is equal to or greater than that of the separation roller 30 and the width of the reversible roller 1 is narrower than that of the separation roller 30, the reversible roller 1 is prevented from being worn locally and the separation roller 30 is prevented from being recessed, thus making the occurrence of the poor sheet feeding and separation, improving the durability of the apparatus and not damaging the sheet to be fed.

Next, the setting of the limit value of the torque limiter will be explained.

Normally, the greater the limit value of the torque limiter the smaller the dispersion in its performance (ratio of dispersion regarding the setting limit value), but the greater the load when the single sheet is fed.

Now, as will be described later, by adopting a speed increasing system to a drive transmitting mechanism from the torque limiter 14 to the reversible roller 1, it is possible to use a torque limiter having the less dispersion in the limit value.

Since the transmitting mechanism comprising the gears 11, 12*a*, 12*b* and 13 is a speed decreasing system, by setting the number of teeth of these gears as follows, the transmitting mechanism is changed to the speed increasing system. That is to say, the numbers of teeth of the gears 11, 12*a*, 12*b* and 13 are selected to 31, 15, 29 and 27, respectively.

There is a relation between the limit value T of the torque limiter 14 and the apparent torque limit value TR in the reversible roller 1, as follows:

$$T=\frac{31}{15}\times\frac{29}{27}TR\simeq 2.2\,TR \quad (16)$$

That is to say, the strength of the actual torque limiter is greater than the torque limit value required at the reversible roller 1 by about 2.2 times. In this embodiment, since the value TR is about 300 gf·cm (in this embodiment, the radius of the reversible roller 1 is 1 cm), the torque limiter having the specification of about 660 gf·cm can be used. When a torque limiter of powder type is used, since there is the dispersion of ±10% (±66 gf·cm) in the limiter having about 660 gf·cm, the apparent dispersion in the reversible roller 1 will be as follows:

$$\pm 66\times\frac{1}{2.2}=\pm 30\,gf\cdot cm \quad (17)$$

On the other hand, since the dispersion in the torque limiter of powder type having about 300 gf·cm is about ±15%, if the torque limiter having 300 gf·cm is directly connected to the reversible roller 1, the dispersion of the torque limit value will be ±45 gf·cm (300×0.15), which is not negligible, unlike to the dispersion of 30 gf·cm in this embodiment of the present invention. Accordingly, if the torque limiter having 300 gf·cm is directly connected to the reversible roller 1, since the dispersion in the loads acting on the separation roller 30 and the feed roller 32 becomes greater in comparison with this embodiment, it is necessary to provide the margin of power in the drive system accordingly, thus requiring a stronger motor which leads to the cost-up.

In this way, by arranging the torque limiter 14 in the drive transmitting means for transmitting the driving force to the reversible roller 1 to provide the speed increasing system in the drive transmitting mechanism from the torque limiter 14 to the reversible roller 1, it is possible to use the torque limiter having the greater torque limit value and the less dispersion, thus suppressing the increase in the manufacturing cost-up.

Incidentally, in this embodiment, when the numbers of teeth of the gears 9 and 10 are set to 10 and 40, respectively, the speed reduction to $\frac{1}{4}$ can be obtained from the pinch roller 3 to the torque limiter 14, and, thus, the total speed reduction from the pinch roller 3 to the reversible roller 1 may be about $\frac{1}{2}$ ($=\frac{1}{4}\times 2.2$). The reason is that the rotational speed of the reversible roller is limited to a predetermined value due to the separating ability of the roller. In this embodiment, in order to consist this limitation with the technical effect of the present invention, the reduction to $\frac{1}{4}$ is firstly obtained and then the speed increase (by twice) is achieved through the torque limiter 14.

Incidentally, in the illustrated embodiment, while the speed increasing system in the drive transmitting mechanism from the torque limiter to the reversible roller 1 achieved the speed increase of 2.2 times, by making the ratio of the speed increase greater, a torque limiter having the greater torque limit value and the less dispersion may be used. Conversely, if the ratio of the speed increase cannot be made greater due to the spacial limitation and the like, the lower speed increase ratio may be used within the scope that the effect of the present invention can be attained.

Further, in the illustrated embodiment, while the speed increase from the torque limiter 14 to the reversible roller 1 was effected at one stage, such speed increase may be effected at two stages by arranging the torque limiter in the gear portion.

As mentioned above, since the torque limiter 14 is disposed in the drive transmitting means for transmitting the driving force to the reversible roller 1 and the speed increasing system is adopted in the drive transmitting mechanism from the torque limiter 14 to the reversible roller 1, it is possible to use the torque limiter having the greater torque limit value and the less dispersion, thus providing the automatic sheet feeding apparatus having the stable separating ability without increasing the manufacturing cost.

Next, a method for improving the separating ability of the reversible roller 1 and the separation roller 30 will be explained.

First of all, only the lowermost sheet is separated by the reversible roller 1 and the separation roller 30 and is fed in the downstream direction. The separated and fed sheet is further fed in the downstream direction by the feed roller 32 and the pinch roller 3.

Since the peripheral speed of the feed roller 32 is greater than that of the separation roller 30, a distance between the sheets being fed can surely be maintained. Further, a one-way clutch 40 is disposed in the drive system for the separation roller 30, so that, when the sheet is being fed by the feed roller 32 and the pinch roller 3, the drive transmission to the separation roller 30 is released by the one-way clutch 40 to rotate the separation roller by the friction force between this roller and the sheet, thus reducing the load acting on the sheet and generated by the difference in speed between the feed roller 32 and the separation roller 30.

By the way, during the small time period, i.e., until the driving force is transmitted to the separation roller 30 via the one-way clutch 40 immediately after a trailing end of the sheet leaves a nip between the separation roller 30 and the reversible roller 1, the separation roller 30 is rotated reversely by the reverse rotation of the reversible roller 1. Thus, the separation roller 30 returns the waiting sheet in the upstream direction, thereby causing the poor sheet feeding and/or the skew-feed of the sheet.

Thus, by adopting an arrangement which will be described hereinbelow, the optimum sheet separation is achieved.

Figure 18A:
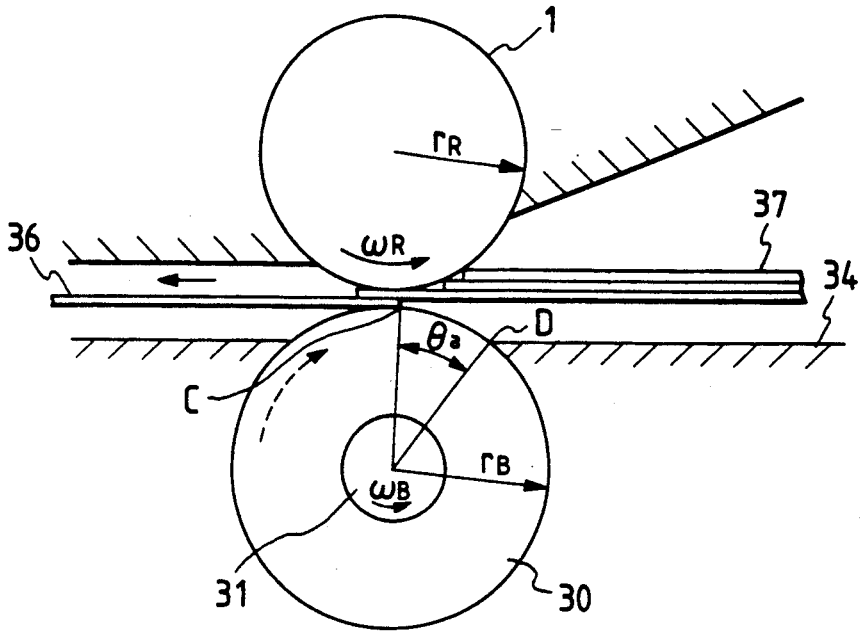
FIGS. 18A and 18B are sectional views showing a contacting point between the reversible roller and the separation roller and thereabout.
Figure 18B:
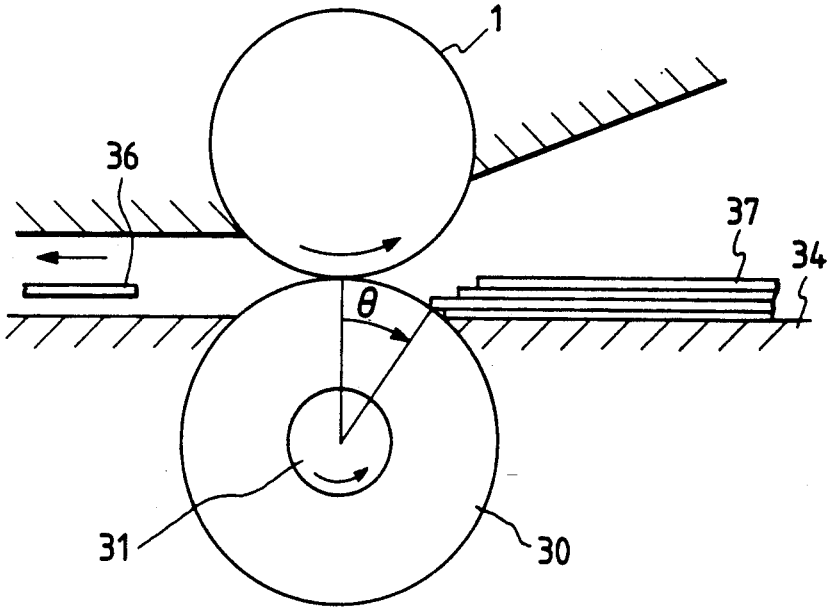

Here, it is assumed that a ratio of the peripheral speed of the separation roller 30 regarding that of the reversible roller 1 is $\alpha$, a peripheral angle of the peripheral surface of a protruded portion of the separation roller 30 from a leading end C of the waiting sheet to a position D disposed at the upstream side of the position C is $\theta_O$ as shown in FIGS. 18A and 18B, and a non-drive transmitting angle or backlash angle of the one-way clutch is $\theta_{BK}$.

Now, when a radius of the reversible roller 1 is $r_R$, an angular velocity of the reversible roller is $\omega_R$, a radius of the separation roller 30 is $r_B$ and an angular velocity of the separation roller is $\omega_B$, and it is assumed that, when t seconds are elapsed after the trailing end of the sheet 36 leaves the leading end position C of the sheet 37 (FIG. 18A), the separation roller 30 rotated by the reversible roller 1 is stopped by the one-way clutch 40 after the rotation of $\theta$ (rad) as shown in FIG. 18B, the displacement amounts of the rollers and shafts occurred during the t time period will be as follows:

$$(\textit{rotation amount of the reversible roller } \mathbf{1}) = r_R\omega_R t \quad (18)$$

$$(\textit{rotation amount of the separation roller } \mathbf{25}) = r_B\theta \quad (19)$$

$$(\textit{rotation angle of the separation roller shaft } \mathbf{27}) = \omega_B t \quad (20)$$

However, since there is the following relations, $$(\textit{rotation amount of the reversible roller } \mathbf{1}) = (\textit{reverse rotation amount of the separation roller } \mathbf{30}) \quad (21)$$

$$(\textit{rotation angle of the separation roller shaft } \mathbf{27}) + \theta = \theta_{BK} \quad (22)$$

when the equations (18)~(20) are added to the equations (21)(22), the following relations can be obtained:

$$r_B\theta = r_R\omega_R t \quad (23)$$

$$\omega_B t + \theta = \theta_{BK} \quad (24)$$

Solving the equations (23), (24), regarding $\theta$ and t, $$\theta = \frac{1}{\frac{r_B\,\omega_B}{r_R\,\omega_R} + 1}\,\theta_{BK} = \frac{1}{\alpha + 1}\,\theta_{BK} \quad (25)$$

-continued $$t = \frac{1}{\omega_B + \frac{r_R}{r_B}\omega_R}\theta_{BK} \quad (26)$$

are obtained.

Although the returning amount of the leading end of the sheet 37 is equal to the reverse rotation amount $r_B\theta$ of the separation roller 30 (equation (19), in order to prevent the distortion of the setting condition of the sheets and the poor sheet feeding, it is desirable that, even when the sheet 37 is returned, the leading end of the sheet is still contacted with the separation roller 30. To achieve this, the following condition is required:

$$\theta < \theta_O \quad (27)$$

If $\theta > \theta_0$, the leading end of the sheet 37 is returned to a point D in FIG. 18A, thus causing the poor sheet feeding. When the equation (25), is added to the condition (27), the relation $$\frac{1}{\alpha + 1}\theta_{BK} < \theta_O \longleftrightarrow \theta_{BK} < (\alpha + 1)\theta_O \quad (28)$$

is obtained, and this relation (28) indicates the predetermined relation between the values $\alpha$, $\theta_O$, $\theta_{BK}$ to prevent the poor sheet feeding. In the illustrated embodiment, since the values $\alpha$, $\theta_{BK}$, $\theta_O$ are 1, 0.4 rad (23°), 0.7 rad (40°), the condition (28) is satisfied as follows:

$$0.4 < (1+1) \times 0.7 = 1.4$$

Thus, the leading end of the sheet 37 is not returned excessively as shown in FIG. 18B (and is still contacted with the separation roller 30), thereby achieving the good sheet feeding. Accordingly, there are no poor sheet stacking, no poor sheet feeding and no skewfeed.

Further, the one-way clutch may be replaced by a needle clutch. Although the needle clutch is somewhat expensive in comparison with the one-way clutch, since the backlash angle $\theta_{BK}$ of the needle clutch is extremely small, the returning amount of the sheet becomes substantially zero, thus more stabilizing the sheet feeding ability.

In the illustrated embodiment, while the value $\alpha$ was 1, by increasing the value $\alpha$ within the range of the available separating ability (i.e., reducing the peripheral speed of the reversible roller 1), the condition (28) can easily be satisfied. In order to increase the value $\alpha$, a distance between the separation roller 30 and the feed roller 32 may be increased to extend the time period during when the stacked sheets are returned by the reversible roller 1 and the lowermost sheet is fed out up to the feed roller 32. By appropriately selecting such distance, it is possible to obtain $\alpha = 2$ or $\alpha = 3$.

In the illustrated embodiment, while the one-way clutch was disposed on the separation roller shaft 31, it may be disposed at a further upstream side in the driving system to reduce the apparent backlash. That is to say, when a distance between the one-way clutch and the separation roller 30 is K, the apparent backlash angle $\theta'_{BK}$ of the separation roller 30 will become $$\theta_{BK}' = \frac{1}{K}\theta_{BK} \quad (29)$$

According to this method, even when the one-way clutch having the relatively great backlash is used, the apparent backlash can be reduced to easily satisfy the condition (28).

As mentioned above, according to the present invention, even when the separation roller 30 is rotated by the rotation of the reversible roller 1 until the separation roller 30 is rotated normally after the trailing end of the sheet leaves the nip between the reversible roller 1 and the separation roller 30, the returning amount of the sheet is small, thus keeping the leading end of the waiting sheet to contact with the peripheral surface of the separation roller 30. Thus, it is possible to achieve the stable sheet feeding function without causing the poor sheet stacking, poor sheet feeding and skew-feed.

What is claimed is:

1. An automatic sheet feeding apparatus, comprising:

a separation roller rotated in a sheet feeding direction;

a reversible roller abutted against said separation roller and rotated in a direction opposite to the sheet feeding direction;

a feed roller disposed at a downstream side of said separation roller and rotated in the sheet feeding direction;

a pinch roller;

supporting means for shifting said pinch roller in a direction toward and away from said feed roller, said pinch roller abutted against said feed roller and rotated in the sheet feeding direction;

driving force transmitting means for transmitting a driving force to said pinch roller and then to said reversible roller; and a torque limiter provided on said driving force transmitting means for interrupting the transmission of the driving torque from said pinch roller to said reversible roller when transmitting torque goes over a predetermined torque value;

wherein the pressure of said pinch roller against said feed roller is adjusted in conformity with a variation in said predetermined torque value in said torque limiter.

2. An automatic sheet feeding apparatus according to claim 1, wherein said supporting means pivotally supports said pinch roller, and said driving force transmitting means generates a moment acting in the direction to urge said pinch roller against said feed roller, on said supporting means, by a rotational force transmitted by said driving force transmitting means.

3. An automatic sheet feeding apparatus according to claim 2, wherein said driving force transmitting means comprises a gear train for transmitting a driving force from said pinch roller to said reversible roller.

4. An automatic sheet feeding apparatus according to claim 2, wherein said supporting means is pivotally provided on a support shaft which is disposed at a downstream side of said reversible roller in the sheet feeding direction.

5. An automatic sheet feeding apparatus according to claim 4, further comprising biasing means connected to said supporting means to bias said pinch roller toward said feed roller.

6. An automatic sheet feeding apparatus according to claim 1, wherein a peripheral speed of said feed roller is greater than that of said separation roller; and further comprising rotary means arranged in a drive portion of said separation roller for rotating said separation roller only in the sheet feeding direction.

7. An automatic sheet feeding apparatus according to claim 6, wherein said rotary means comprises a one-way clutch.

8. An automatic sheet feeding apparatus according to claim 2, wherein the moment acting on said supporting means is increased in conformity with an increase in said predetermined torque value of said torque limiter to thereby increase said pressure on said pinch roller against said feed roller.

9. An automatic sheet feeding apparatus according to claim 8, wherein said pinch roller receives the rotation of said feed roller to be rotated, which rotation is transmitted to said reversible roller by said drive force transmitting means.

10. An automatic sheet feeding apparatus according to claim 9, further comprising reversible roller supporting means for pivotally supporting said reversible roller.

11. An automatic sheet feeding apparatus according to claim 10, wherein a moment in the direction to separate said reversible roller from said separation roller is created in said reversible roller supporting means by a rotational force transmitted through said driving force transmitting means to said reversible roller, and a moment in a direction to urge said reversible roller against said separation roller is created in said reversible roller supporting means by a friction force that said reversible roller receives from said separation roller.

12. An automatic sheet feeding apparatus, comprising:

a separation roller rotated in a sheet feeding direction;

a reversible roller abutted against said separation roller and rotated in a direction opposite to the sheet feeding direction;

first supporting means pivotally provided on a support shaft and adapted to support said reversible roller for movement toward and away from said separation roller;

a feed roller disposed at a downstream side of said separation roller and rotated in the sheet feeding direction;

a pinch roller abutted against said feed roller and rotated in the sheet feeding direction;

second supporting means pivotally provided on the said support shaft and adapted to support said pinch roller for movement toward from away from said feed roller;

driving force transmitting means for transmitting a driving force to said reversible roller and said pinch roller; and interruption means provided in said driving force transmitting means and adapted to interrupt the transmission of the driving force in response to a load;

wherein said driving force transmitting means generates a force acting in a direction that said reversible roller is separated from said separation roller and a force acting in a direction that said pinch roller is urged against said feed roller by the transmitting driving force, and said support shaft is so positioned as to generate a force acting in a direction that said reversible roller is urged against said separation roller by a friction force that said reversible roller is received from said separation roller.

13. An automatic sheet feeding apparatus according to claim 12, wherein said support shaft is disposed at a position where a force acting in a direction that said pinch roller is urged against said feed roller by friction force of said pinch roller received from said feed roller.

14. An automatic sheet feeding apparatus according to claim 13, wherein said driving force transmitting means comprises a gear train for transmitting a driving force from a gear arranged on said support shaft to said reversible roller, and said gear train generates a moment acting in the direction that said reversible roller is separated from said separation roller, on said first supporting means, by a rotational force of said gear arranged on said support shaft.

15. An automatic sheet feeding apparatus according to claim 13, wherein said driving force transmitting means comprises a gear train for transmitting a driving force from a gear arranged on said support shaft to said pinch roller, and said gear train generates a moment acting in the direction that said pinch roller is urged against said feed roller, on said second supporting means, by a rotational force of said gear arranged on said support shaft.

16. An automatic sheet feeding apparatus according to claim 12, wherein said driving force transmitting means comprises a gear train including a plurality of gears, and said gear train is so arranged that a driving force is transmitted between a gear connected to said reversible roller and a gear connected to said pinch roller via a gear arranged on said support shaft.

17. An automatic sheet feeding apparatus according to claim 16, wherein said pinch roller is followed to the rotation of said feed roller, and the rotation of said pinch roller is transmitted to said reversible roller via said gear train.

18. An automatic sheet feeding apparatus according to claim 12, wherein said interruption means comprises a torque limiter connected to a gear arranged on said support shaft.

19. An automatic sheet feeding apparatus according to claim 12, further comprising first biasing means connected to said first supporting means and adapted to bias said reversible roller toward said separation roller, and second biasing means connected to said second supporting means and adapted to bias said pinch roller toward said feed roller.

20. An image reading system, comprising:

a separation roller rotated in a sheet feeding direction;

a reversible roller abutted against said separation roller and rotated in a direction opposite to the sheet feeding direction;

a feed roller disposed at a downstream side of said separation roller and rotated in the sheet feeding direction;

a pinch roller supporting means for shifting said pinch roller in a direction toward and away from said feed roller, said pinch roller abutted against said feed roller and rotated in the sheet feeding direction;

driving force transmitting means for transmitting a driving force to said pinch roller and then to said reversible roller;

a torque limiter provided on said driving force transmitting means for interrupting the transmission of the driving torque from said pinch roller to said reversible roller when transmitting torque goes over a predetermined torque value; and reading means for reading an image on a sheet separated and fed one by one by means of said separation roller and said reversible roller;

wherein the pressure of said pinch roller against said feed roller is adjusted in conformity with a variation in said predetermined torque value in said torque limiter.

21. An image reading system, comprising:

a separation roller rotated in a sheet feeding direction;

a reversible roller abutted against said separation roller and rotated in a direction opposite to the sheet feeding direction;

first supporting means pivotally provided on a support shaft and adapted to support said reversible roller for movement toward and away from said separation roller;

a feed roller disposed at a downstream side of said separation roller and rotated in the sheet feeding direction;

a pinch roller abutted against said feed roller and rotated in the sheet feeding direction;

second supporting means pivotally provided on the said support shaft and adapted to support said pinch roller for movement toward and away from said feed roller;

driving force transmitting means for transmitting a driving force to said reversible roller and said pinch roller;

interruption means provided in said driving force transmitting means and adapted to interrupt the transmission of the driving force in response to a load; and reading means for reading an image on a sheet separated one by one by means of said separation roller and said reversible roller and fed by said pinch roller and said feed roller;

wherein said driving force transmitting means generates a force acting in a direction that said reversible roller is separated from said separation roller and a force acting in a direction that said pinch roller is urged against said feed roller by the transmitting driving force, and said support shaft is so positioned as to generate a force acting in a direction that said reversible roller is urged against said separation roller by a friction force that said reversible roller is received from said separation roller.

22. An automatic sheet feeding apparatus, comprising:

a separation roller rotated in a sheet feeding direction;

a reversible roller abutted against said separation roller and rotated in a direction opposite to the sheet feeding direction;

a feed roller disposed at a downstream side of said separation roller and rotated in the sheet feeding direction;

a pinch roller abutted against said feed roller and rotated in the sheet feeding direction;

supporting means pivotally provided on a support shaft and adapted to support said pinch roller for movement toward and away from said feed roller;

driving force transmitting means for transmitting a driving force to said reversible roller through said support shaft; and a torque limiter provided on said drive force transmitting means for interrupting the transmission of a driving torque of a predetermined torque value or greater to said reversible roller;

wherein the torque applied around said supporting shaft to urge said pinch roller against said feed roller is adjusted in conformity with a variation in said predetermined torque value in said torque limiter.

23. An image reading apparatus, comprising:

a separation roller rotated in a sheet feeding direction;

a reversible roller abutted against said separation roller and rotated in a direction opposite to the sheet feeding direction;

a feed roller disposed at a downstream side of said separation roller and rotated in the sheet feeding direction;

a pinch roller abutted against said feed roller and rotated in the sheet feeding direction;

supporting means pivotally provided on a support shaft and adapted to support said pinch roller for movement toward and away from said feed roller;

driving force transmitting means for transmitting a driving force to said reversible roller through said support shaft;

a torque limiter provided on said drive force transmitting means for interrupting the transmission of a driving torque of a predetermined torque value or greater to said reversible roller; and reading means for reading an image on a sheet separated one by one by means of said separation roller and said reversible roller and fed by said pinch roller and said feed roller;

wherein the torque applied around said supporting shaft to urge said pinch roller against said feed roller is adjusted in conformity with a variation in said predetermined torque value in said torque limiter.

* * * * *

UNITED STATES PATENT AND TRADEMARK OFFICE

CERTIFICATE OF CORRECTION

PATENT NO. : 5,290,024

DATED : March 1, 1994

INVENTOR(S) : Takahashi

It is certified that error appears in the above-indentified patent and that said Letters Patent is hereby corrected as shown below:

Column 4,
Line 56, "constitutes" should read --constitute--.

Column 5,
Line 36, "0," should read --n--.

Column 8,
Line 26, "rom" should read --from--.

Column 9,
Line 67, "more" should be deleted.

Column 12,
Line 48, "no almost" should read --almost no--; and
Line 49, "completely coincided," should read --completely coincide--.

Column 17,
Line 9, "19," should read --19),--;
Line 19, "25," should read --25)--; and
Line 26, "$\theta_{BK}$to" should read --$\theta_{BK}$ to--.

UNITED STATES PATENT AND TRADEMARK OFFICE

CERTIFICATE OF CORRECTION

PATENT NO. : 5,290,024

DATED : March 1, 1994

INVENTOR(S) : Takahashi

It is certified that error appears in the above-indentified patent and that said Letters Patent is hereby corrected as shown below:

Column 19,
Line 45, "from" (first occurrence) should read --and--;
and
Line 48, "and" should read --from--.

Column 20,
Line 51, "roller supporting" should read --roller;--,
new paragraph --supporting--.

Signed and Sealed this

Thirtieth Day of August, 1994

Bruce Lehman

*Attest:*

BRUCE LEHMAN

*Attesting Officer*

*Commissioner of Patents and Trademarks*